US006102535A

United States Patent [19]

Papenfuhs et al.

[11] Patent Number: 6,102,535

[45] Date of Patent: Aug. 15, 2000

[54] INK CARTRIDGE WITH CLOSING DEVICE

[75] Inventors: Ralph Papenfuhs, Gerolsbach; Manuela Rau, Nürnberg, both of Germany

[73] Assignee: J.S. Staedtler GmbH & Co., Nürnberg, Germany

[21] Appl. No.: 09/373,808

[22] Filed: Aug. 13, 1999

[30] Foreign Application Priority Data

Aug. 14, 1998 [DE] Germany ..... 198 36 924

[51] Int. Cl.[7] ..... B41J 2/175

[52] U.S. Cl. ..... 347/86

[58] Field of Search ..... 347/84, 85, 86, 347/87, 29

[56] References Cited

U.S. PATENT DOCUMENTS

| | | | |
|---|---|---|---|
| 5,329,294 | 7/1994 | Ontawar et al. | 397/87 |
| 5,557,310 | 9/1996 | Kurata et al. | 347/87 |
| 5,802,818 | 9/1998 | Doll et al. | 347/85 |
| 5,940,104 | 8/1999 | Karita et al. | 347/87 |
| 5,946,014 | 8/1999 | Shimomura et al. | 347/87 |

FOREIGN PATENT DOCUMENTS

| | | |
|---|---|---|
| 0425254 | 5/1991 | European Pat. Off. . |
| 0577439 | 1/1994 | European Pat. Off. . |
| 0685339 | 12/1995 | European Pat. Off. . |
| 4425693 | 4/1995 | Germany . |
| 296 03 466 U 1 | 8/1997 | Germany . |
| 196 15 997 A1 | 10/1997 | Germany . |

*Primary Examiner*—N. Le
*Assistant Examiner*—Anh T. N. Vo
*Attorney, Agent, or Firm*—Friedrich Kueffner

[57] ABSTRACT

An ink cartridge with a closing device for ink jet printers or similar writing, printing or drawing units, wherein the ink cartridge in the printer as well as the closing device are releasably mounted on the ink cartridge, wherein the ink cartridge can be filled manually or automatically with ink from an external tank, wherein the ink cartridge includes at least one housing, an ink reservoir and a refill opening, and wherein the refill opening is closeable by the closing device. The closing device includes at least two different closing elements, wherein a first element provides a sealing action and is a plug or a closing cap and a second element is constructed as an air-permeable compensating cap and includes a compensating body which is in the condition of use impregnated with a writing agent, a surface-active agent or tenside, with water, organic solvent or another liquid, wherein the closing elements or caps can be exchanged against each other and/or can be connected to each other and can be mounted on the ink cartridge and/or on each other.

13 Claims, 3 Drawing Sheets

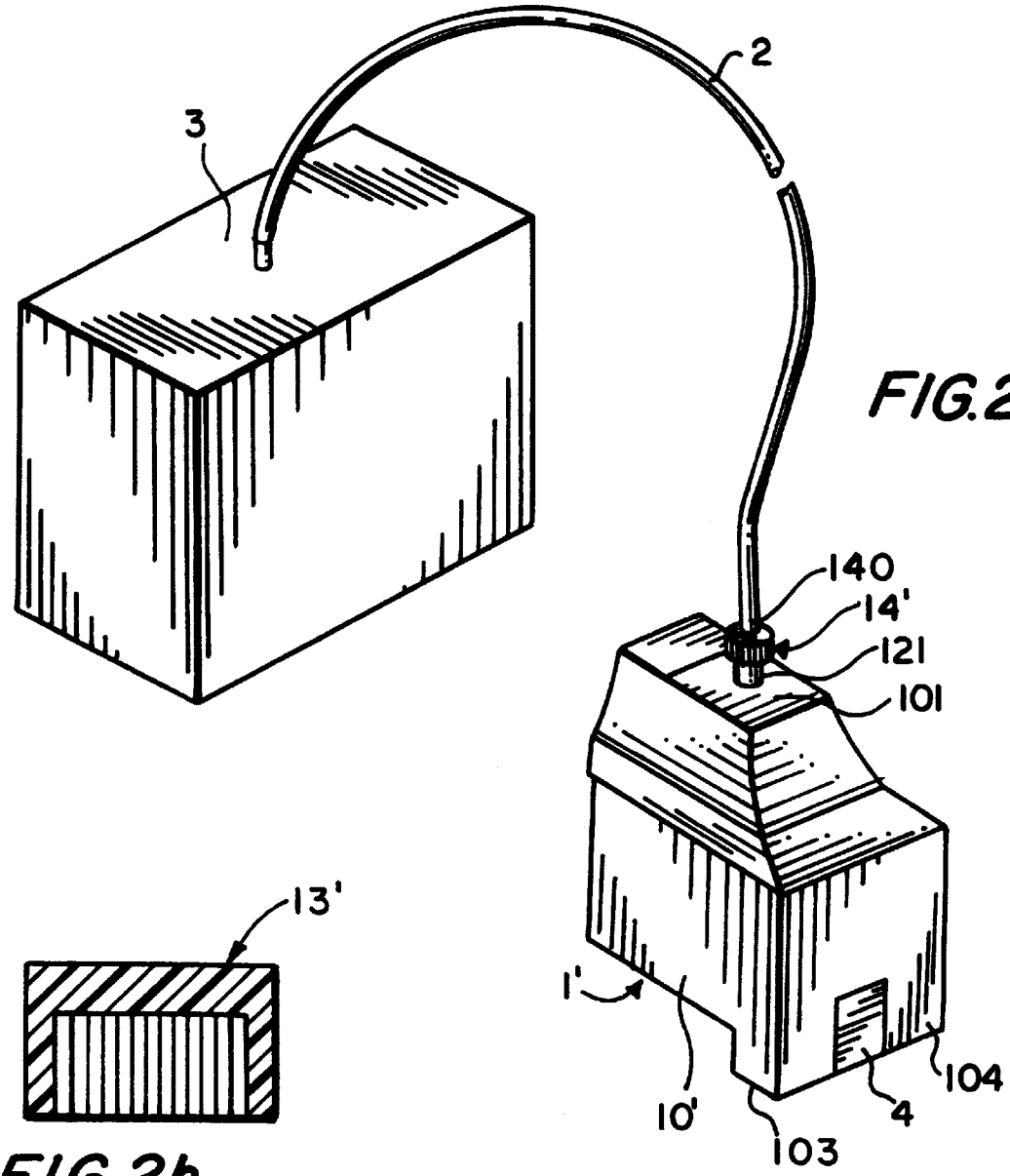
FIG. 2a
FIG. 2b
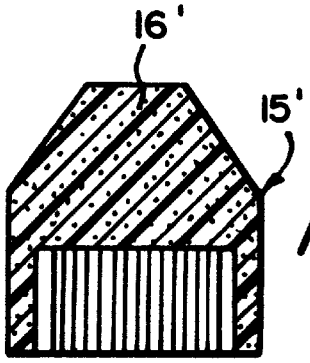
FIG. 2c

INK CARTRIDGE WITH CLOSING DEVICE

BACKGROUND OF THE INVENTION

1. Field of the Invention

The present invention relates to an ink cartridge with a closing device for ink jet printers or similar writing, printing or drawing units, wherein the ink cartridge in the printer as well as the closing device are releasably mounted on the ink cartridge, wherein the ink cartridge can be filled manually or automatically with ink from an external tank, wherein the ink cartridge includes at least one housing, an ink reservoir and a refill opening, and wherein the refill opening is closeable by the closing device.

2. Description of the Related Art

Closeable ink cartridges of the above-described type are connected permanently or exchangeably to a printer head and/or to a printer and are either manually refillable as necessary or are continuously supplied with ink, for example, through a hose system, from a larger external tank. However, in principle, disposable cartridges may also be used or modified.

The ink cartridges of this type are used in ink jet systems which include all usually electronically controlled automatic writing, drawing and printing units or devices which use preferably so called ink jet heads for producing writing or illustrations and whose ink storage units are usually releasably mounted and connected to the printer head directly or indirectly through an ink supply system, wherein the writing or drawing medium is particularly ink and the discharge elements are printer heads with jets as outlet openings in different arrangements and sizes.

These printers, which usually can be filled or refilled through exchangeable ink cartridge and/or also through hose supply systems, sometimes also operate with modified cartridges which can be exchangeably placed into the respective printer head or which are permanently connected to the printer head and are then mounted completely as a unit in the printer.

In that case, the ink cartridges may be modified to the extent that they have on there housing a coupling element, such as, for example, a connecting pipe piece, which is constructed for making it possible to easily refill the cartridge or to connect a hose system which is in communication with a large ink tank and is possibly provided with a closing device.

The volume of the ink tank may be a multiple of the filling volume of a commercially available filled ink cartridge for ink jet printers.

The connecting pipe piece may also be used for manually filling the cartridge and is usually closed in an air-tight manner with a closing cap.

Various solutions for ink cartridges and systems of this type are known in the art.

For example, DE 196 15 997 A1 discloses a manually refillable ink cartridge with an ink tank for free ink and a compensating and regulating system, and with a refill opening which during use in the system is closed in an air-tight manner with a closing cap.

DE 296 03 466 U1 and U.S. Pat. No. 5,329,294 disclose devices for manually refiling ink cartridges, wherein after filling the filling opening is once again closed in an air-tight manner with an elastomer plug or with an adhesive strip.

A particular disadvantage of the known systems is the fact that the ink contained in the ink cartridge does not last very long particularly when printing large surface areas, and that the respective ink cartridge has to be frequently exchanged or refilled as a result. In addition, these cartridges require storage filters and/or other usually complicated buffer elements or compensating systems for ensuring a regulated discharge of the ink through the printer head and for preventing the undesired discharge of ink, for example, in the case of pressure increases in the system or when air enters in an uncontrolled manner.

These ink cartridges or printer heads with ink reservoirs cannot be refilled through a tank/hose system, but are to be exclusively manually filled with a refill bottle or with an injection device.

Consequently, ink cartridges have already been modified in practice in such a way that the filling opening was provided with a hose connection through which a continuous ink supply from a large additional tank and simultaneously also a controlled discharge of the ink were made possible. The connected hose or the hose system and the supply control usually also serve as a pressure compensating element which acts by regulating the ink flow from the printer head or the jet plate through negative pressure and prevents ink from being discharged during non-use.

The filling opening or the hose connection are usually sealed in an air-tight manner with a releasable closing cap when the cartridge is transported or stored.

Such printer heads or cartridges have the disadvantage that, when the hose system is not connected and when no buffer system is present, the ink contained in the cartridge or the printer head can run out almost entirely unimpededly when the closing opening is not closed air-tight, or the flow of ink is interrupted quickly when sufficient air is prevented from entering the cartridge. Consequently, such cartridges or printer heads cannot be used for short periods of time for testing purposes and they cannot be safely used under normal operating conditions.

Another disadvantage of central supply systems with hose connections is the fact that a change of the type of ink, for example, from textile inks or pigment inks or black inks to color inks or the like, or also a short "intermediate test" with other media, can only be carried out with a complicated and expensive complete cleaning of the entire system and, thus, was not possible in the past without problems.

SUMMARY OF THE INVENTION

Therefore, it is the primary object of the present invention to eliminate the disadvantages described above and to provide an ink cartridge provided with or connectable to a printer head which may also be connectable to a tank/hose system through which the long-term ink supply for long-term operation and possibly also the pressure regulation takes place, wherein the cartridge or printer head may also be usable at times independently of the tank/hose system and without any modifications and change, and wherein the user can continue to use the printer head and possibly also the ink cartridge, for example, after a test has been carried out, under normal conditions, i.e., with or without tank/hose system.

In accordance with the present invention, the closing device includes at least two different closing elements, wherein a first element provides a sealing action and is a plug or a closing cap and a second element is constructed as an air-permeable compensating cap and includes a compensating body which is in the condition of use impregnated with a writing agent, a surface-active agent or tenside, with water, organic solvent or another liquid, wherein the closing elements or caps can be exchanged against each other and/or can be connected to each other and can be mounted on the ink cartridge and/or on each other.

The various features of novelty which characterize the invention are pointed out with particularity in the claims annexed to and forming a part of the disclosure. For a better understanding of the invention, its operating advantages, specific objects attained by its use, reference should be had to the following descriptive matter in which there are described preferred embodiments of the invention.

BRIEF DESCRIPTION OF THE DRAWING

In the drawing:

FIG. 2*a* is a perspective view of another embodiment of the ink cartridge with a tank/hose system and with a connecting cap;

FIG. 2*b* is a sectional view of a closing cap for the ink cartridge of FIG. 2*a;*

FIG. 2*c* is a sectional view of a compensating cap for the ink cartridge of FIG. 2*a;*

DESCRIPTION OF THE PREFERRED EMBODIMENTS

Figure 1B:
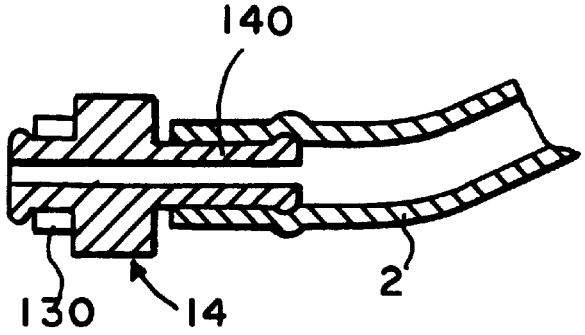
FIG. 1*b* a sectional view of a connecting cap for the ink cartridge of FIG. 1*a;*
Figure 1C:
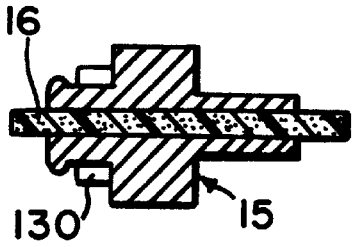
FIG. 1*c* a sectional view of a compensating cap for the ink cartridge of FIG. 1*a;*
Figure 1A:
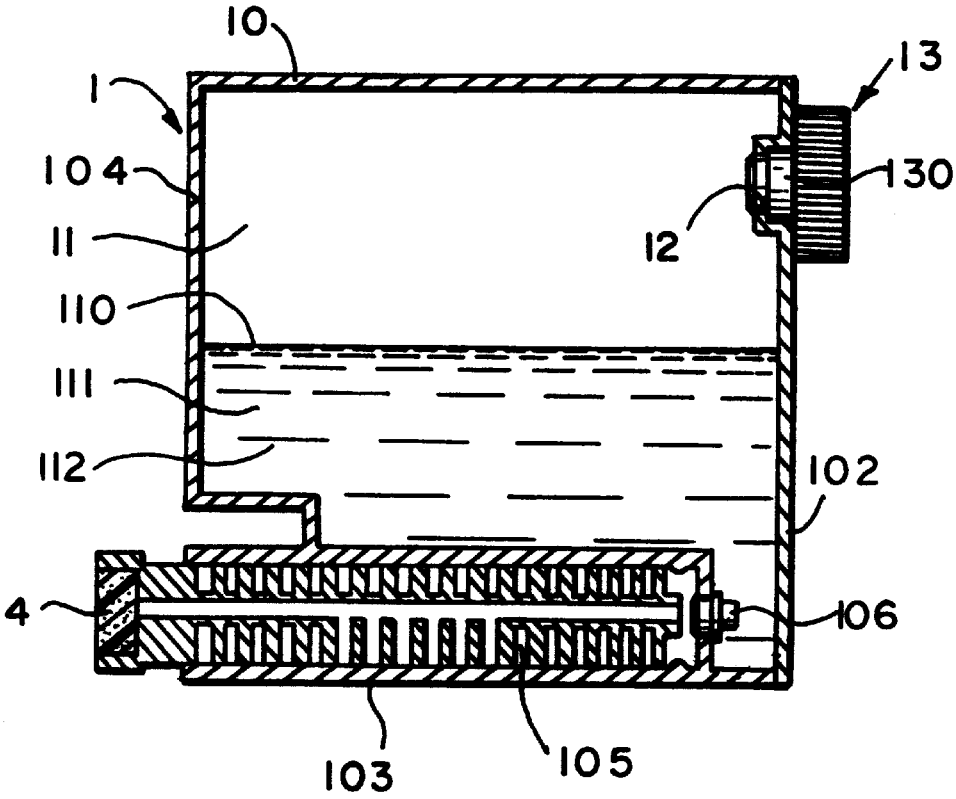
FIG. 1*a* is a schematic sectional view of a first embodiment of the ink cartridge with compensating system and closing cap.

The ink cartridge 1 for an ink jet printer illustrated in FIG. 1*a* includes a housing 10 with an ink reservoir 11 partially filled with free ink 110 or with test ink 111 or with cleaning liquid 112, and with a regulating system 105 at the bottom 103 with a printer ink connection 4 at the front side 104. Provided at the rear wall 102 is a refill opening 12 closed with a closing cap 13. The regulating system 105 is not yet activated as shown in FIG. 1*a* because the ink closure 106 has not yet been released.

The closing cap 13 provided with a sealing member 130 is removed from the refill opening 12 for refilling the ink reservoir 11, so that filling can then be carried out manually through the refilling opening 12, for example, with a refill bottle.

FIG. 1*b* shows a corresponding connecting cap 14. For longer use, the closing cap 13 can be replaced by the connecting cap 14 which is equipped with a sealing member 130 and with a hose connection 140, so that a continuous ink supply can take place, for example, through a hose-shaped supply line 2 from a larger tank.

When alternatively using a compensating cap 15 as illustrated in FIG. 1*c*, which also includes a sealing member 130 and additionally an appropriately adjusted compensating body 16, the ink reservoir 11 or its contents can usually be discharged completely without problems. For effecting a secure closure, all caps 13, 14, 15 to be used or mounted may have a separated sealing member 130 or integrally formed sealing edges.

FIG. 2*a* shows in a simplified manner the filling of the ink cartridge 1' through a hose/tank system. Ink is continuously supplied from the external tank 3 through a supply line 2 constructed as a hose into the ink cartridge 1'. The supply line 2 is attached to the hose connection 140 of the connecting cap 14' which, in turn, is releasably arranged at the connecting pipe piece 121 at the cover 101 of the ink cartridge 1'. Depending on the type of cartridge, a printer head connection 4 or the printer head itself is located at the front side 104 and at the bottom 103 of the housing 10'.

FIGS. 2*b* and 2*c* each show a corresponding closing cap 13' and a compensating cap 15' which is constructed entirely as an air-permeable compensating body 16' of granular synthetic material or of sintered ceramic powder, and which is provided with a protective coating where it is handled.

If this ink cartridge 1' is to be filled and operated, for example, for a short time with a test ink or with a cleaning liquid, the connecting cap 14' or also only the supply line 2 are disconnected and the compensating cap 15' with the compensating body 16' is mounted alternatively or additionally. Using this equipment, a test printing or a jet cleaning can be carried out without problems. During longer work stoppages, the closing cap 13' is advantageously mounted either alternatively or once again additionally through the compensating cap in order to prevent the contents from evaporating or drying out.

Ink cartridges prefilled at the factory initially also have a sealing closing cap 13, 13' and additionally have an exchangeable compensating cap 15, 15', 15". If the connecting pipe piece 121 is already from the outset constructed as a correctly fitting hose connection, the additional use of a connecting cap 14 may be unnecessary.

On the other hand, this closing system makes it possible to also use high-quality "test printing heads" or ink cartridges which are already equipped with complete jet heads which are usually expensive. When the "test ink" or the cleaning agent contained in the ink cartridge is used up, it is only necessary to exchange the compensating cap 15' against the connecting cap 14' if no other hose connection exists, so that it is possible to further operate, for example, with the conventional external ink supply.

Figure 3A:
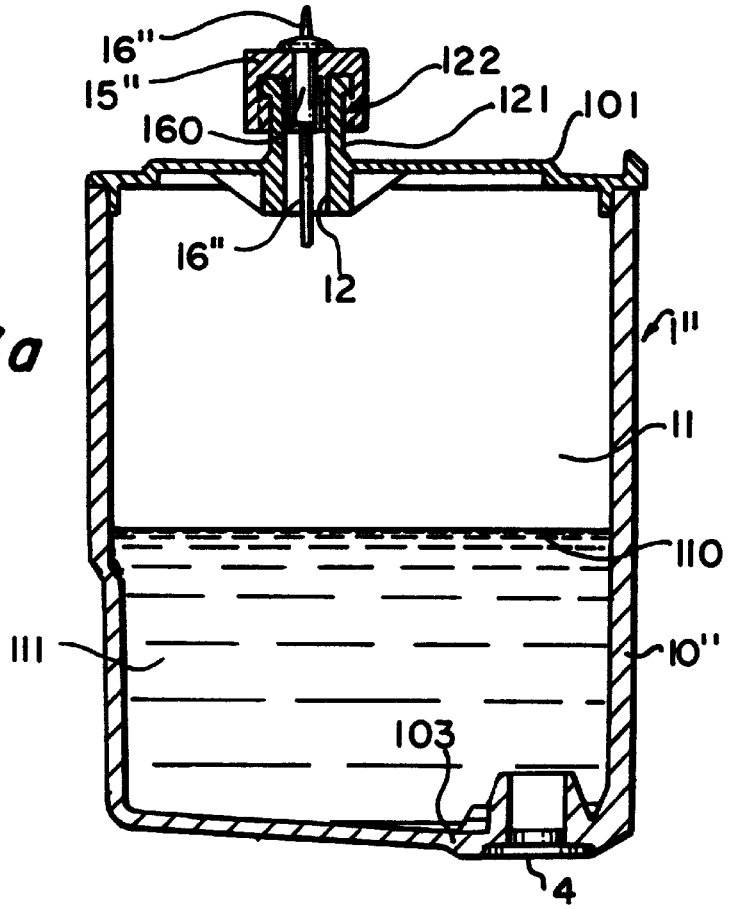
FIG. 3*a* is a schematic sectional view of another embodiment of an ink cartridge with a compensating cap.
Figure 3B:
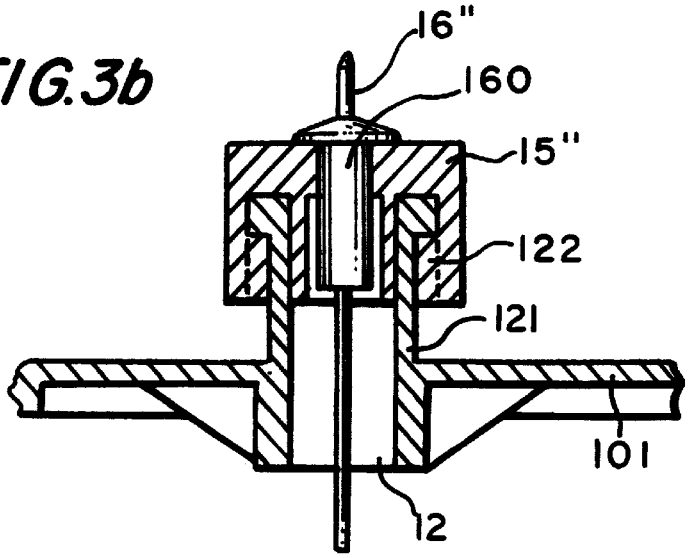
FIG. 3*b* a sectional view, on a larger scale, showing the compensating cap of FIG. 3*a*.

The ink cartridge 1" illustrated in FIGS. 3*a* and 3*b* includes a cover 101 which has been subsequently mounted on the housing 10". The cover 101 includes a connecting projection 121 with thread 122 extending the refill opening 12 toward the outside. Placed on the connecting projection 121 is the compensating cap 15" into which a wick fitting 160 with a continuous compensating body 16" is rigidly inserted.

Shown at the bottom 103 is the printer head connection 4 through which the test ink 111 contained in the cartridge is discharged. The connecting projection 121 can be constructed in such a way that it is a direct hose connection when the ink cartridge 1" is to be continued to use for regular operation. For safely connecting the compensating body 15" to the ink cartridge 1", a thread 122 is provided at each of the two components. Alternatively, bayonet-type connections or simple plug-type connections can be chosen if this is sufficient with respect to load-bearing capability.

In accordance with a first advantageous embodiment of the present invention, in an ink cartridge with a closing device for ink jet printers and similar writing, printing or drawing units, the ink cartridge in the printer as well as the closing device at the ink cartridge are to be arranged so as to be releasable, wherein the ink cartridge may also be filled with ink from an external tank, for example, through a hose system. This ink cartridge has at least one housing, an ink reservoir and a refill opening and the refill opening can be closed by a closing device. In accordance with the invention, the closing device is constructed as a set and is composed of at least two different closing elements, wherein one element acts in a sealing manner and is constructed as a plug or a closing cap 13, 13' and the other element is constructed as an air-permeable body or a compensating cap 15, 15', 15", wherein both closing elements or caps 13, 13'; 15, 15', 15" are constructed so as to be exchangeably against each other and are mountable on the ink cartridge 1, 1', 1" or on each other.

In accordance with another embodiment including a set of caps, the closing device is composed of three or more different closing elements, wherein at least one is constructed as a closing cap 13, 13', a second element is constructed as a connecting cap 14, 14' and a third element is constructed as a compensating cap 15, 15', 15", and wherein all three elements or caps 13, 13'; 14, 14'; 15, 15', 15" are constructed so as to be exchangeable against each other and/or mountable on each other.

If the compensating cap 15, 15', 15" is totally or partially permeable to air and is constructed as a compensating body 16' or at least contains a compensating body 16, 16", the contents of the ink cartridge can be used up when operated correctly.

The connecting cap 14, 14' must be permeable to liquid and have, for example, a tubular or plug-shaped hose connection 140, so that the cartridge can also be operated in a long-term operation connected to central ink supplies.

To make it possible that the corresponding closing elements can be used as a set so as to be exchangeable against each other and/or connectable to each other, the closing cap 13, 13', the connecting cap 14, 14' and the compensating cap 15, 15', 15" should have the same connecting and fastening means and means for exchanging the caps against each other or connecting them to each other.

If the compensating cap 15' as a whole is not constructed as a compensating body 16', the cap 15, 15" should include at least one compensating body 16, 16" which is constructed, for example, as a porous insert and is fixedly mounted in the compensating cap 15, 15'.

The compensating body 16, 16" advantageously may be a fiber wick, or also an elastic sponge, a felt insert or a rigid insert of sintered ceramic material or of sintered polyethylene or another synthetic material. If the compensating cap 15' is manufactured, for example, as sintered material and constitutes the entire compensating body 16', the cap may be varnished or otherwise coated or sheathed in a liquid-type manner.

In accordance with a particularly simple solution, the compensating body 16, 16" may be a conventional sintered, extruded or fibrous writing wick, and may have a defined wick thickness, preferably, with a diameter of 0.05 to 5.0 mm.

If the air permeability of the compensating body 16, 16', 16" is too high, the compensating body advantageously can be impregnated with writing agent, for example, by turning over the ink cartridge and allowing the compensating body to absorb the writing agent, with a surface-active agent or tenside, with water, with organic solvent or with another liquid which is compatible with the contents and which may slow down the passage of air.

The ink reservoir 11 for receiving free ink 110 should advantageously not have any additional intake or insert components, so that the contents can be easily and cleanly used up and exchanged. As a result, the ink reservoir 11 can also be filled as required or at times, for example, with a special test ink 111 or with cleaning liquid 112.

If the respective closing cap 13, 13', the possibly provided connecting cap 14, 14' and the complementary connected compensating cap 15, 15', 15" or other interacting components of the ink cartridge 1, 1', 1" are constructed and dimensioned in such a way that they can be coupled to each other, i.e., such that, for example, the closing cap 13, 13' is directly mounted on the connecting projection 121 of the ink cartridge 1, 1', 1" or on a connecting cap 14, 14' already mounted on the connecting projection, or the closing cap is sealingly mounted on the compensating cap 15, 15', 15" which may already mounted on the connecting cap, then all components of the set can also be connected to each other, for example, for transport or storage. In principle, the system can then also be used with a mounted connecting cap 14, 14' and a compensating cap 15, 15', 15" fastened on the connecting cap and can be sealed and stored for a longer period of time during work stoppages by mounting the closing cap 13, 13' on the compensating cap.

However, a particular advantage of the proposed solution resides in the fact that a use of conventional ink cartridges with corresponding printer heads is possible without problems independently of the tank/hose system, i.e., no significant modifications have to be carried out. This also reduces the costs because the usually used printer head is a regularly sold article and, thus, an expensive printer head with ink reservoir is not required for testing purposes or for cleaning.

If a conventional felt writer tip, for example, with metal holder, is used as the compensating body 16, 16" for air regulation, this already constitutes a suitable base body. For manufacturing a suitable compensating cap 15" it is merely necessary to fill a central hole in a normal closing cap 13, 13' and to insert the fiber writer tip with metal holder with a force to be defined tightly into the drilled hole. This makes possible a defined pressure compensation which can be modified by the selection of the diameter, the porosity or the pore density and possibly by an appropriate impregnation of the compensating body 16, 16', 16", in order to achieve the optimum ink discharge volume for the entire system or for the medium being used at a given time.

The invention is not limited by the embodiments described above which are presented as examples only but can be modified in various ways within the scope of protection defined by the appended patent claims.

We claim:

1. An ink cartridge with closing device for ink jet printers and similar writing, printing or drawing units, wherein the ink cartridge is adapted to be releasably mounted in a printer, and wherein the ink cartridge is configured to be filled manually or automatically with ink from an external tank, the ink cartridge comprising a housing, an ink reservoir formed by the housing, and a refill opening in the housing, wherein the refill opening is closeable by the closing device, the closing device comprising at least two different elements, the elements including a first element for sealing the refill opening, the first element being comprised of a plug or a closing cap, and another element comprised of an air-permeable compensating cap and comprising a compensating body, wherein the compensating body in a state of use is impregnated with writing agent, a surface-active agent or tenside, with water, organic solvent or another liquid, and wherein the at least two elements are configured so as to be exchangeable against each other or connectable to each other and so as to be mountable on the ink cartridge or on each other.

2. The ink cartridge according to claim 1, wherein the closing device comprises at least three different elements including the closing cap and the compensating cap and further comprising a connecting cap, and wherein the at least three elements are configured so as to be exchangeable against each other or connectable to each other and so as to be mountable on the ink cartridge or on each other.

3. The ink cartridge according to claim 2, wherein the connecting cap is permeable to liquid and comprises a tubular or plug-shaped hose connection.

4. The ink cartridge according to claim 2, wherein the closing cap, the connecting cap and the compensating cap comprise identical connecting and fastening means so as to be exchangeable against each other or connectable to each other.

5. The ink cartridge according to claim 4, wherein the connecting means are configured and dimensioned such that the closing cap can be placed sealingly directly on a connecting projection of the ink cartridge or on the closing cap mounted on the connecting projection or on the compensating cap.

6. The ink cartridge according to claim 1, wherein the air-permeable compensating cap comprises the compensating body or comprises a plurality of compensating bodies.

7. The ink cartridge according to claim 6, wherein at least one compensating body is composed of a porous insert fixedly mounted in the compensating cap.

8. The ink cartridge according to claim 7, wherein the compensating body is a fiber wick.

9. The ink cartridge according to claim 7, wherein the compensating body is comprised of an elastic sponge, a felt insert or a rigid insert or body of sintered ceramic or of sintered polyethylene.

10. The ink cartridge according to claim 7, wherein the compensating body comprises a sintered, extruded or fibrous writing wick and has a defined wick thickness.

11. The ink cartridge according to claim 10, wherein the compensating body has a diameter of 0.05 to 5.0 mm.

12. The ink cartridge according to claim 1, wherein the ink reservoir is free of additional intake or insert components.

13. The ink cartridge according to claim 1, wherein the ink reservoir is filled with special test ink or cleaning liquid.

* * * * *